US005260255A

United States Patent [19]

Sudo et al.

[11] Patent Number: 5,260,255

[45] Date of Patent: Nov. 9, 1993

[54] HEAT TRANSFER IMAGE-RECEIVING SHEET

[75] Inventors: Kenichiro Sudo; Hiroshi Eguchi, both of Tokyo, Japan

[73] Assignee: Dai Nippon Insatsu Kabushiki Kaisha, Japan

[21] Appl. No.: 601,127

[22] Filed: Oct. 23, 1990

[30] Foreign Application Priority Data

Oct. 26, 1989 [JP] Japan ..... 1-277105
Nov. 7, 1989 [JP] Japan ..... 1-287964

[51] Int. Cl.[5] ..... B41M 5/035

[52] U.S. Cl. ..... 503/227; 428/195; 428/421; 428/447; 428/913; 428/914

[58] Field of Search ..... 503/227; 428/195, 913, 428/914, 421, 447

[56] References Cited

U.S. PATENT DOCUMENTS 4,778,782 10/1988 Ito ..... 503/227
4,910,188 3/1990 Akada ..... 503/227

FOREIGN PATENT DOCUMENTS 62-066995 3/1987 Japan .
62-218186 9/1987 Japan ..... 428/484

OTHER PUBLICATIONS

Database Japio, No 86-143176, Orbit Search Service California, U.S.; & JP-A-61143176 (Dainippon Printing) published Jun. 30, 1986.
Database Japio, No 870135389, Orbit Search Service California, U.S.; & JP-A-62135389 (Nippon Shokubai KK) published Jun. 18, 1987.
Database WPIL, No 89-290434, Derwent Publications Ltd., London, GB; & JP-A-1214475 (Toa Gosei) Aug. 28, 1989.

*Primary Examiner*—Patrick J. Ryan
*Assistant Examiner*—W. Krynski
*Attorney, Agent, or Firm*—Parkhurst, Wendel & Rossi

[57] ABSTRACT

A heat transfer image-receiving sheet including a substrate sheet, a dye-receiving layer formed on the surface side of the substrate sheet and a slip layer formed on the back side of the substrate sheet. That slip layer includes a graft copolymer in which at least one releasable segment selected from the group consisting of a polysiloxane segment, a carbon fluoride segment and a long-chain alkyl segment is grafted on its main chain.

18 Claims, 2 Drawing Sheets

HEAT TRANSFER IMAGE-RECEIVING SHEET

BACKGROUND OF THE INVENTION

The present invention relates to a heat transfer image-receiving sheet used in combination with a heat transfer sheet.

Among various heat transfer techniques so far known in the art, there is a sublimation type of transfer system wherein a sublimable dye as a recording material is carried on a substrate sheet such as paper or a plastic film to make a heat transfer sheet, which is in turn overlaid on a heat transfer sheet dyeable with a sublimable dye, for instance, a heat transfer sheet comprising paper or a plastic film having a dye-receiving layer on its surface to make various full-color images thereon.

In such a system, the thermal head of a printer is used as heating means to transfer three-, four- or more-color dots onto the heat transfer image-receiving sheet by quick heating, thereby reproducing full-color images of manuscripts with said multicolor dots.

When the heat transfer image-receiving sheet used with such a sublimation type of heat transfer system as mentioned above is required to form a light reflecting image, as is the case with generally available prints or photographs, it is formed of an opaque substrate sheet such as a paper or synthetic paper sheet having on its surface a dye-receiving layer of a resin capable of being well-dyed with a dye. When it is required to provide a light transmitting image which is used with an overhead projector (hereinafter OHP for short), etc., on the other hand, it is formed of a transparent sheet such as a polyester film having thereon such a dye-receiving layer as referred to above.

When imaging is carried out with either one of such heat transfer image-receiving sheets, there is an increase in the temperature prevailing in the printer. This poses troubles or problems such as curling of the heat transfer image-receiving sheets or degradations of their slip properties and blocking resistance, which result in sheet jamming or multiple feeding of several sheets at one time.

The curling problem may be solved by forming a curlproof layer of a suitable resin on the back side of the heat transfer image-receiving sheet. However, if such image-receiving sheets, placed one upon another, are fed through a sheet feeder unit of the printer, then the multiple feeding problem arises, because the coefficient of friction between the curlproof layer of the sheet above and the dye-receiving layer of the sheet below is high. This problem may be solved to some extent by adding a slip agent such as silicone oil to the curlproof layer. However, the silicone oil tends to bleed through the image-receiving sheet or otherwise pass into the dye-receiving sheet below, posing various problems.

It is therefore a first object of this invention to provide a heat transfer image-receiving sheet which is so improved in terms of in-printer slip properties, blocking resistance and curling resistance that it can form a high-quality image without causing any printing trouble.

It is here noted that images obtained with the heat transfer techniques excel in clearness, color reproducibility and other factors and so are of high quality comparable to that of conventional photographic or printed images, because the colorant used is a dye. Especially when imaging is carried out with transparent films or sheets for OHPs, a transmission type of image of improved clearness and high resolution can advantageously be projected.

The image-receiving sheet for OHPs is provided with a detection mark for positioning. However, conventional detection marks have been formed of black, white or silver inks, all having high shielding properties. As a result, an image projected on a screen becomes dull, since the detection mark throws a black shadow on the screen.

Another problem with the image formed with OHPs is that an OHP film is so curled by the heat generated from a projector's light source that it is troublesome to handle and the projected image is distorted.

It is therefore a second object of this invention to provide a transparent type of heat transfer image-receiving sheet which is free from the above-mentioned problems of the prior art and which provides an attractive image at the time of projection and is not curled in use.

SUMMARY OF THE INVENTION

The above-mentioned first object is achieved by the following aspect of this invention.

According to the first aspect of this invention, there is provided a heat transfer image-receiving sheet including a substrate sheet, a dye-receiving layer formed on the front side of the substrate sheet and a slip layer formed on the back side of the substrate sheet, characterized in that the slip layer comprises a graft copolymer containing at least one of releasable segments selected from the groups consisting of polysiloxane, carbon fluoride and long-chain alkyl segments, the segment or segments being grafted on the main chain of the graft copolymer.

The slip layer of a heat transfer image-receiving sheet is formed of such a specific releasable graft copolymer as referred to above, thereby making it possible to improve the in-printer slip properties, blocking resistance and curlproofness thereof and form a high-quality image without causing any printing trouble.

The above-mentioned second object is achieved by the following second aspect of this invention.

According to the second aspect of this invention, there is provided a transparent type of heat transfer image-receiving sheet including a transparent substrate sheet having a transparent dye-receiving layer on the surface side, characterized in that the image-receiving sheet is provided on a part of at least one side with a light transmitting, colored detection mark.

A transparent type of heat transfer image-receiving sheet for OHPs, etc. is provided on a part of at least one side with a light transmitting, colored detection mark, whereby said detection mark is projected in colors on a screen to prevent the projected image from becoming dull.

By providing a curlproof layer, it is also possible to prevent curling of the image-receiving sheet by the heat emitted from a light source.

ILLUSTRATIVE EXPLANATION OF THE INVENTION

Figure 1:
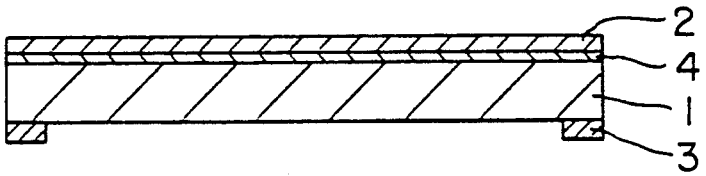
FIGS. 1 and 2 each are a sectional view of the heat transfer image-receiving sheet which embodies this invention.

The first aspect of this invention will now be explained in greater detail with reference to the preferred embodiments.

The heat transfer image-receiving sheet according to the first aspect of this invention includes a substrate sheet, a dye-receiving layer formed on the surface side of the substrate sheet and a slip layer formed on the back side of the substrate sheet.

No limitation is placed on the substrate sheets used in the present invention. For instance, use may be made of various types of paper such as synthetic paper (based on polyolefin, polystyrene, etc.), fine paper, art paper, coated paper, cast coated paper, wall paper, backing paper, synthetic resin or emulsion impregnated paper, synthetic rubber latex impregnated paper, synthetic resin intercalated paper, paper board and cellulose fiber paper; and various kinds of plastic films or sheets based on, e.g., polyolefin, polyvinyl chloride, polyethylene terephthalate, polystyrene, polymethacrylate and polycarbonate. Use may also be made of white, opaque films or foamed sheets obtained from such synthetic resins to which white pigments and fillers are added. These substrate sheets may be laminated together in any desired combination. The substrate sheet or sheets may have any desired thickness, for instance, a thickness of generally about 10 to 300 μm. If required, plasticizers, etc. may be added to the plastic films to regulate their rigidity.

For particular applications where light transmitting images are required for OHPs, a polyethylene terephthalate film having a thickness of about 50–200 μm is preferably used.

The dye-receiving layer to be provided on the surface side of the substrate sheet is to receive a sublimable dye coming from a heat transfer sheet and maintain the resulting image.

The resins used to form the dye-receiving layer, for instance, may include polyolefinic resins such as polypropylene; halogenated vinyl resins such as polyvinyl chloride and polyvinylidene chloride; vinylic resins such as polyvinyl acetate and polyacryl ester; polyester resins such as polyethylene terephthalate and polybutylene terephthalate; polystyrene type resins; polyamide type resins; copolymeric resins such as copolymers of olefins such as ethylene and propylene with other vinyl monomers; ionomers; cellulosic resins such as cellulose diacetate; and polycarbonate. Particular preference is given to vinylic resins and polyester resins.

The dye-receiving layer of the heat transfer image-receiving sheet according to the first aspect of this invention may be formed by coating on at least one major side of the substrate sheet a solution or dispersion in which the binder resin is dissolved or dispersed in a suitable organic solvent or water together with the required additives such as release agents, antioxidants and UV absorbers by suitable means such as gravure printing, screen printing or reverse roll coating using a gravure, followed by drying.

For applications where light reflecting images are needed, the dye-receiving layer may be formed by adding to the resin pigments or fillers such as titanium oxide, zinc oxide, kaolin, clay, calcium carbonate and finely divided silica, thereby improving its whiteness and so making the clearness of the resulting image much higher. For OHP and other purposes, the dye-receiving layer may be made substantially transparent.

The thus formed dye-receiving layer may have any desired thickness, but is generally 1 to 50 μm in thickness. Such a dye-receiving layer should preferably be in a continuous film form, but may be formed into a discontinuous film with the use of a resin emulsion or dispersion.

The slip layer, by which the first aspect of this invention is primarily characterized, is provided to prevent curling of the heat transfer image-receiving sheet by the heat of a thermal head during heat transfer and improve the blocking resistance and slip properties of the heat transfer image-receiving sheets when placed one upon another. To this end, a specific graft copolymer, that is, a graft copolymer having at least one of releasable segments selected from polysiloxane, carbon fluoride and long-chain alkyl segments, the segment or segments being grafted on the main chain of the graft copolymer, is formed on the back side of the substrate sheet.

As the main chain-forming polymers, use may be made of those having a reactive functional group and known in the art. More illustratively, preference is given to cellulosic resins such as ethyl cellulose, hydroxyethyl cellulose, ethylhydroxy cellulose, hydroxypropyl cellulose, methyl cellulose, cellulose acetate and cellulose acetate butyrate; acrylic resins; polyvinylic resins such as polyvinyl alcohol, polyvinyl acetate, polyvinyl butyral, polyvinyl acetal, polyvinyl pyrrolidone and polyacrylamide; polyamide type resins; polyurethane type resins; and polyester type resins. The most preference, however, is given to the acrylic, vinylic, polyester type, polyurethane type, polyamide type or cellulosic resins in consideration of curlproofness.

The releasable graft copolymers used in this invention may be synthesized in various manners. According to one preferable method, the main chain is formed, followed by the reaction of a functional group present in it with a releasable compound having a functional group reactive therewith.

Examples of the releasable compounds having a functional group are:

(a) Polysiloxane Compounds

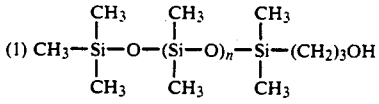

(1) $CH_3-Si(CH_3)_2-O-(Si(CH_3)_2-O)_n-Si(CH_3)_2-(CH_2)_3OH$

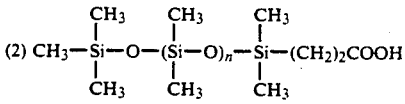

(2) $CH_3-Si(CH_3)_2-O-(Si(CH_3)_2-O)_n-Si(CH_3)_2-(CH_2)_2COOH$

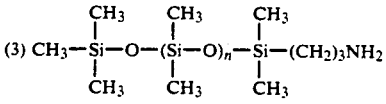

(3) $CH_3-Si(CH_3)_2-O-(Si(CH_3)_2-O)_n-Si(CH_3)_2-(CH_2)_3NH_2$

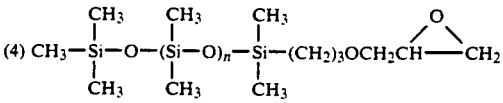

(4) $CH_3-Si(CH_3)_2-O-(Si(CH_3)_2-O)_n-Si(CH_3)_2-(CH_2)_3OCH_2CH(\overset{O}{\triangle})CH_2$ -continued

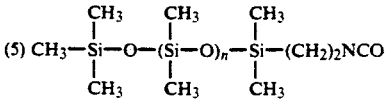

(5) $CH_3-Si(CH_3)_2-O-(Si(CH_3)_2-O)_n-Si(CH_3)_2-(CH_2)_2NCO$

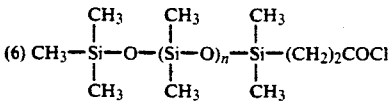

(6) $CH_3-Si(CH_3)_2-O-(Si(CH_3)_2-O)_n-Si(CH_3)_2-(CH_2)_2COCl$

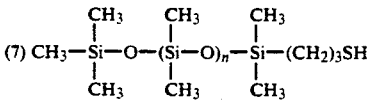

(7) $CH_3-Si(CH_3)_2-O-(Si(CH_3)_2-O)_n-Si(CH_3)_2-(CH_2)_3SH$

In the above-mentioned formulae, it is noted that a part of the methyl group may be substituted by other alkyl group or an aromatic group such as a phenyl group, and n stands for an integer of about 1-500.

(b) Fluoroalkyl Compounds (8) $C_8F_{17}C_2H_4OH$
(9($C_6F_{13}C_2H_4OH$

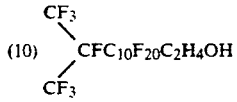

(10) $(CF_3)_2CFC_{10}F_{20}C_2H_4OH$

(11) $C_8F_{17}C_2H_4OH$
(12) $C_{10}F_{21}C_2H_4OH$
(13) $C_8F_{17}SO_2N(C_2H_5)C_2H_4OH$
(14) $C_8F_{17}SO_2N(C_2H_5)C_2H_4OH$
(15) $C_6F_{13}COOH$
(16) $C_6F_{13}COCl$
(17) $C_8F_{17}C_2H_4SH$

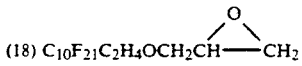

(18) $C_{10}F_{21}C_2H_4OCH_2CH(O)CH_2$ (c) Long-Chain Alkyl Compounds

Higher fatty acids such as lauric, myristic, palmitic, stearic, oleic and linoleic acids or their acid halogenides; higher alcohols such as nonyl, capryl, lauryl, myristyl, cetyl, stearyl, oleyl, linoleyl and ricinoleyl alcohols; higher aldehydes such as caprin, laurin, myristin and stearin aldehydes; and higher amines such as decylamine, laurylamine and cetylamine.

These compounds are mentioned for the purpose of illustration alone. Other various reactive releasable compounds, now commercialized, are all available in the first aspect of this invention. Particular preference is given to mono-functional releasable compounds each having one functional group per molecule. Di- or polyfunctional compounds are unpreferred, because they tend to gelate the resulting graft copolymers.

The interrelation between the aforesaid releasable compounds and the above-exemplified resins is tabulated below. In the table, X stands for a functional group of each releasable compound while Y denotes a functional group of each polymer, and vice versa. These polymers and reins may be used in admixture. It is understood that other desired polymers and resins may be used, provided that they are reactive with each other.

| X | Y |
|---|---|
| —NCO | —OH, —$NH_2$, —NHR—, —COOH, —SH etc. |
| —COCl | —OH, —$NH_2$, —NHR—, —SH etc. |
| 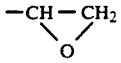 | —OH, —$NH_2$, —COOH etc. |
| 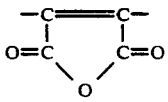 | —OH, —$NH_2$, —NHR—, —SH etc. |
| —OH, —SH | 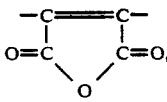 —O, —NCO, COOR, —CHO, —COCl, —COOH etc. |
| —$NH_2$, —NHR— | 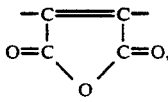 —O, —NCO, COOH, —COCl, 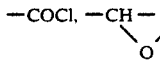 etc. |
| —COOH | 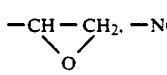 —$CH_2$, —NCO, —OH, —$NH_2$, —NHR etc. |

According to another preferable method, the aforesaid functional releasable compound is permitted to react with a vinylic compound having a functional group reactive with a functional group thereof to prepare a releasable segment-containing monomer. This monomer is copolymerized with various vinyl monomers, thereby obtaining desired graft copolymers.

According to still another preferable method, a mercapto compound such as Compound (7) or the aforesaid releasable vinyl compound is added to a polymer having an unsaturated double bond in its main chain, such as an unsaturated polyester or a copolymer of vinyl monomer with a diene compound such as butadiene for grafting.

While some preferable methods for preparing the graft copolymers have been described, it is understood that graft copolymers prepared by other methods or commercially available graft copolymers of the same type may be used in the first aspect of this invention.

Preferably, the releasable segment or segments should account for 3 to 60% by weight of the graft copolymer. In too small an amount no satisfactory blocking resistance and slip properties are obtainable, whereas in too large an amount a problem arises in connection with the adhesion of the slip layer to the substrate sheet.

Of the releasable graft copolymers, some have a high content of the releasable segment and make the adhesion of the slip layer to the substrate sheet insufficient due to their increased releasability. Such a problem can be solved by using with the graft copolymer an adhesive resin having a relatively high Tg of, say, at least 60° C., for instance, such a resin as used to form the dye-receiving layer or a resin forming the main chain of the graft copolymer. At too low a Tg, the slip layer may be softened by the heat generated during heat transfer, failing to achieve sufficient slip properties and blocking resistance.

The adhesion of the slip layer to the substrate sheet may be much more improved by subjecting the surface of the substrate sheet to primer or corona discharge treatments.

In accordance with the first aspect of this invention, it is preferable to add finely divided, organic and/or inorganic particles (a filler) to the slip layer comprising the graft copolymer.

The filler used may include plastic pigments such as fluorine resin, polyamide resin, styrene resin, styrene/acrylic type of crosslinked resin, phenolic resin, urea resin, melamine resin, aryl resin, polyimide resin and benzoguanamine resin; and inorganic fillers such as calcium carbonate, silica, clay, talc, titanium oxide, magnesium hydroxide and zinc oxide; all having preferably a particle size of 0.5 to 30 μm.

These fillers may be used alone or in admixture, and the choice of the type of the filler used may be determined depending upon the use what the heat transfer image-receiving sheet is used for. In the case of the heat transfer image-receiving sheet for light reflecting images, for instance, use may be made of less transparent inorganic fillers such as titanium or zinc oxide, because no problem arises even when the slip layer becomes opaque. For light transmitting images, however, plastic pigments of an increased transparency or inorganic fillers having a reduced particle size should preferably be used. Although varying with the type of the filler used, the filler may account for 0.02 to 10% by weight, preferably 0.05 to 2% by weight of the slip layer. An amount of the filler departing from the above-defined range is undesired, because in less than the lower amount, the filler gives rise to no improvement in slip properties while in higher than the upper amount, light is so scattered throughout the slip layer that the light transmittance drops.

In order to form the slip layer, the graft copolymer is dissolved in a suitable organic solvent or dispersed in an organic solvent or water, if required, together with other resins and fillers and the necessary additives, thereby preparing a solution or dispersion. Then, the solution or dispersion is coated and dried on the back side of the substrate sheet by suitable means such as gravure printing, screen printing or reverse roller coating with a gravure. In general, the thus formed slip layer has a thickness of about 1–10 μm.

The heat transfer sheet used for carrying out heat transfer with the heat transfer image-receiving sheet according to the first aspect of this invention includes a sublimable dye-containing layer on a polyester film. For the first aspect of this invention, conventional heat transfer sheets known in the art may all be used as such.

As heat energy applying means for heat transfer, conventional applicator means hitherto known in the art may be used. For instance, the desired object is successfully achievable by the application of a heat energy of about 5 to 100 mJ/mm$^2$ for a controlled recording time with recording hardware such as a thermal printer (e.g., Video Printer VY-100 commercialized by Hitachi Co., Ltd.).

According to the first aspect of this invention which has been described above, there is provided a heat transfer image-receiving sheet which has a slip layer formed of a specific releasable graft copolymer, thereby improving its in-printer slip properties, blocking resistance and curlproofness and so making it possible to form a high-quality image without any printing trouble.

The second aspect of this invention will now be explained in greater detail with reference to the preferred embodiments.

Figure 2:
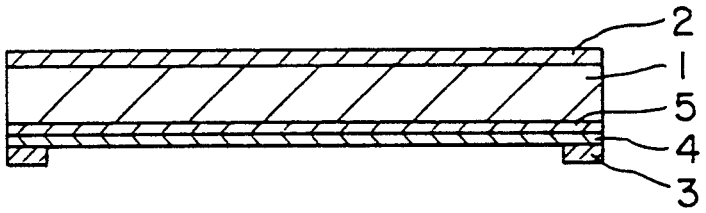

As illustrated in FIG. 1 or 2, the heat transfer image-receiving sheet according to this aspect comprises a transparent substrate sheet 1, a dye-receiving layer 2 formed on the surface side of the substrate sheet 1 and a transparent detection mark 3 formed on at least one side of the substrate sheet 1. In a preferred embodiment, a curlproof layer 4 is provided on either one side of the substrate sheet 1.

As is the case with conventional films for OHP (overhead projector), the transparent substrate sheet 1 used in this invention may be formed of a film or sheet of various plastics such as acetyl cellulose, polyolefin, polyvinyl chloride, polyethylene terephthalate, polystyrene, polymethacrylate and polycarbonate. Although not critical, these substrate sheets may generally have a thickness of about 50 to 200 μm for OHP purposes.

Some of the substrate sheets as mentioned above are poor in the adhesion to the dye-receiving layer formed on the surface side thereof. In such cases, they should preferably be subjected on their surfaces to primer or corona discharge treatments.

The dye-receiving layer 2 provided on the surface side of the substrate sheet 1 is to receive a sublimable dye coming from a heat transfer sheet and maintain the resulting image.

The resins used to form the dye-receiving layer 2, for instance, may include polyolefinic resins such as polypropylene; halogenated vinyl resins such as polyvinyl chloride and polyvinylidene chloride; vinylic resins such as polyvinyl acetate and polyacryl ester; polyester resins such as polyethylene terephthalate and polybutylene terephthalate; polystyrene type resins; polyamide type resins; copolymeric resins such as copolymers of olefins such as ethylene and propylene with other vinyl monomers; ionomers; cellulosic resins such as cellulose diacetate; and polycarbonate. Particular preference is given to vinylic resins and polyester resins.

The dye-receiving layer 2 of the heat transfer image-receiving sheet according to the second aspect of this invention may be formed by coating on at least one major side of the substrate sheet a solution or dispersion in which the binder resin is dissolved or dispersed in a suitable organic solvent or water together with the required additives such as release agents, antioxidants and UV absorbers by suitable means such as gravure printing, screen printing or reverse roll coating using a gravure, followed by drying.

The thus formed dye-receiving layer 2 may have any desired thickness, but is generally 1 to 50 μm in thickness. Such a dye-receiving layer should preferably be in a continuous film form, but may be formed into a discontinuous film with the use of a resin emulsion or dispersion.

The second aspect of this invention is primarily characterized in that the transparent type of heat transfer image-receiving sheet is provided on at least a part of its one major side with a light transmitting, colored detection mark 3. This detection mark 3 may be provided on either one major side of the heat transfer image-receiving sheet.

As illustrated in FIGS. 3A–3F, the detection mark 3 is generally provided on an edge of the transparent type of heat transfer image-receiving sheet, thereby achieving the alignment of the sheet with the surface of a projector's light source and enabling the projected image to be in correct alignment with a screen. In embodiments illustrated in FIGS. 3A-3D, detection marks are provided on the side of each substrate sheet on which no dye-receiving layer is provided, whereas in embodiments in FIGS. 3E and 3F, detection marks are provided on the surfaces of the dye-receiving layers.

According to the second aspect of this invention, the light transmitting detection mark 3, for instance, may be formed of an ink consisting of a dye solution or an ink with a transparent pigment dispersed in it. Alternatively, it may be formed by the heat transfer of a sublimable dye. This alternative embodiment is more preferred because, as illustrated in FIG. 3F, a detection mark 3 can be formed simultaneously with imaging.

Preferred examples of the dye used to this end are an oil-soluble dye soluble in solvents, a disperse dye and a basic dye. Preferred examples of the transparent pigment, on the other hand, include a transparent pigment used for usual offset printing ink.

The image-carrying light transmittance of each or the detection mark 3 is determined depending upon the concentration of the colorant used. According to the second aspect of this invention, however, the image-carrying light transmittance is preferably in the range of 0.3 to 0.8. Difficulty would be encountered in the alignment of the projected image with a screen at below 0.3, whereas the detection mark becomes dim at above 0.8, casting a dark shadow on a screen.

In accordance with a preferred embodiment of this aspect, a curlproof layer 4 of a less thermally expandable/shrinkable resin is provided on at least one side of the substrate sheet 1, as illustrated in FIG. 1 or 2, thereby providing an effective prevention of an OHP film from being curled by the heat emanating from a projector's light source during projection.

Preferred examples of the less thermally expandable/shrinkable resin are acrylic, polyurethane, polycarbonate, vinylidene chloride, epoxy, polyamide and polyester resins. Some of these resins differ largely in thermal properties. Thus, the most preference is given to resins whose shrinkages upon heating are in the range of −1.0 to 1.5% as measured at 100° C. for 10 minutes according to JIS-K-6734 and whose softening temperatures lie at 90° C. or higher.

By adding a filler to the resin, it is possible to impart good slip properties to the curlproof layer 4, when formed on the back side of the substrate 1 as shown in FIG. 2. Thus, the in-printer blocking and multiple feeding problems can be solved. The filler used may include plastic pigments of an increased transparency such as fluorine resin, polyamide resin, styrene resin, styrene/acrylic type of crosslinked resin, phenolic resin, urea resin, melamine resin, aryl resin, polyimide resin and benzoguanamine resin; and inorganic fillers of an increased transparency such as calcium carbonate, silica, clay, talc, titanium oxide, magnesium hydroxide and zinc oxide. Of these resins, preference is given to a resin having an increased heat resistance and a particle size of 0.5 to 30 μm. These fillers should be added to the resin in an amount sufficient to prevent a drop of the general transparency of the curlproof layer.

In order to form the curlproof layer 4, such a resin as mentioned above is dissolved in a suitable organic solvent or dispersed in an organic solvent or water together with the necessary additives, thereby preparing a solution or dispersion. Then, the solution or dispersion is coated and dried on one side of the substrate sheet by suitable means such as gravure printing, screen printing or reverse roller coating with a gravure. In general, the thus formed slip layer has a thickness of about 1-10 μm. When the adhesion between the curlproof layer and the substrate sheet is not proper, it is preferred that the substrate sheet be previously provided on the side with a primer layer 5 made of resin such as polyurethane, polyester, acrylic or epoxy resin.

According to the second aspect of this invention, the image-receiving sheet may be wholly or partly colored with either a blue dye or a specific pigment in a specific manner. Such light transmitting bluing is not only effective in improving the storability of the image-receiving sheet but also greatly beneficial to making it easy to look at an image on a showing box, as is the case with roentgenography.

In order to achieve such effects, it is preferred that the chromaticity value of the image-receiving sheet be such that it falls within a blue region the CIE system (CIE 1931) of color representation surrounded by the following three points:

(x=0.310, y=0.316)
(x=0.285, y=0.280)
(x=0.275, y=0.320)

Blue dyes so far known in the art may be used as the dyes for carrying out such dyeing. In consideration of heat stability, however, particular preference is given to anthraquinone type dyes. Use may also be made of organic and inorganic blue dyes such as phthalocyanine blue, cerulean blue and cobalt blue.

To this end, at least one of the transparent substrate sheet, the transparent dye-receiving layer and the adhesive and curlproof layers laminated thereon additionally or if required may be blued.

The heat transfer sheet used for carrying out heat transfer with the heat transfer image-receiving sheet according to the second aspect of this invention includes a sublimable dye-containing layer on a polyester film. For the second aspect of this invention, conventional heat transfer sheets known in the art may all be used as such.

As heat energy applying means for heat transfer, conventional applicator means hitherto known in the art may be used. For instance, the desired object is successfully achievable by the application of a heat energy of about 5 to 100 mJ $mm^2$ for a controlled recording time with recording hardware such as a thermal printer (e.g., Video Printer VY-100 made by Hitachi Co., Ltd.).

In accordance with the second aspect of this invention in which the colored, transparent detection mark is provided on a part of at least one side of the transparent type of heat transfer image-receiving sheet for OHP and other purposes, the projected image is allowed to look well, since the detection mark is projected in colors on a screen.

Especially because the detection mark 3 is transparent, it may bear a graphic or symbolic title or caption written or marked in a black or white ink of high shielding properties. In this case, such characters, etc. may be projected in black on a screen against a colored background.

Provision of the curlproof layer also makes it possible to prevent the film from being curled by the heat emanating from the projector's light source during projection.

The present invention will now be explained more illustratively with reference to a number of examples and comparative examples in which, unless otherwise stated, the "part" and "%" are given by weight.

REFERENCE EXAMPLE A1

Forty (40) parts of a copolymer of 95 mole % of methyl methacrylate with 5 mole % of ethyl methacrylate were dissolved in 400 parts of a mixed solvent consisting of methyl ethyl ketone and toluene equivalent in quantity. Then, 10 parts of Polysiloxane Compound (5) (having a molecular weight of 3,000) were slowly added dropwise to the solution at a reaction temperature of 60° C. for 5 hours to obtain a homogeneous reaction product, from which the polysiloxane compound could not be separated by fractional precipitation. This means that the polysiloxane compound reacted with the acrylic resin. By analysis, the polysiloxane segment content was found to be about 7.4%.

REFERENCE EXAMPLE A2

Fifty (50) parts of a polyvinyl butyral (having a polymerization degree of 1,700 and a hydroxy content of 33 mole %) were dissolved in 500 parts of a mixed solvent consisting of methyl ethyl ketone and toluene equivalent in quantity. Then, 10 parts of Polysiloxane Compound (5) (having a molecular weight of 3,000) were slowly added dropwise to the solution at a reaction temperature of 60° C. for 5 hours to obtain a homogeneous reaction product, from which the polysiloxane compound could not be separated by fractional precipitation. This means that the polysiloxane compound reacted with the polyvinyl butyral resin. By analysis, the polysiloxane segment content was found to be about 5.2%.

REFERENCE EXAMPLE A3

Seventy (70) parts of a polyester consisting of 45 mole % of dimethyl terephthalate, 5 mole % of dimethyl monoaminoterephthalate and 50 mole % of trimethylene glycol were dissolved in 700 parts of a mixed solvent consisting of methyl ethyl ketone and toluene equivalent in quantity. Then, 10 parts of Polysiloxane Compound (4) (having a molecular weight of 10,000) were slowly added dropwise to the solution at a reaction temperature of 60° C. for 5 hours to obtain a homogeneous reaction product, from which the polysiloxane compound could not be separated by fractional precipitation. This means that the polysiloxane compound reacted with the polyester resin. By analysis, the polysiloxane segment content was found to be about 5.4%.

REFERENCE EXAMPLE A4

Eighty (80) parts of a polyurethane resin (having a molecular weight of 6,000) obtained from polyethylene adipatediol, butanediol and hexamethylene diisocyanate were dissolved in 800 parts of a mixed solvent consisting of methyl ethyl ketone and toluene equivalent in quantity. Then, 10 parts of Polysiloxane Compound (6) (having a molecular weight of 2,000) were slowly added dropwise to the solution at a reaction temperature of 60° C. for 5 hours to obtain a homogeneous reaction product, from which the polysiloxane compound could not be separated by fractional precipitation. This means that the polysiloxane compound reacted with the polyurethane resin. By analysis, the polysiloxane segment content was found to be about 4.0%.

REFERENCE EXAMPLE A5

Dissolved in 1,000 parts of a mixed solvent of methyl ethyl ketone and toluene equivalent in quantity were 100 parts of a mixture consisting of 5 mole % of a monomer obtained by the reaction of Polysiloxane Compound (3) (having a molecular weight of 1,000) with methacrylic acid chloride at a molar ratio of 1:1, 45 mole % of methyl methacrylate, 40 mole % of butyl acrylate and 10 mole % of styrene and 3 parts of azobisisobutyronitrile for a 6-hour polymerization at 70° C., which gave a viscous polymerization solution of homogeneity. From this product, the polysiloxane could not be separated by fractional precipitation. By analysis, the polysiloxane segment content was found to be about 6.1%.

REFERENCE EXAMPLE A6

Fifty (50) parts of a styrene/butadiene copolymer (having a molecular weight of 150,000 and a butadiene content of 10 mole %) and 2 parts of azobisisobutyronitrile were dissolved in 500 parts of a mixed solvent consisting of methyl ethyl ketone and toluene equivalent in quantity. Then, 10 parts of Polysiloxane Compound (7) (having a molecular weight of 10,000) were slowly added dropwise to the solution at a reaction temperature of 60° C. for 5 hours to obtain a homogeneous reaction product, from which the polysiloxane compound could not be separated by fractional precipitation. This means that the polysiloxane compound reacted with the copolymer. By analysis, the polysiloxane segment content was found to be about 6.2%.

REFERENCE EXAMPLE A7

Eighty (80) parts of hydroxyethyl cellulose were dissolved in 800 parts of a mixed solvent consisting of methyl ethyl ketone and toluene equivalent in quantity. Then, 10 parts of Polysiloxane Compound (6) (having a molecular weight of 2,000) were slowly added dropwise to the solution at a reaction temperature of 60° C. for 5 hours to obtain a homogeneous reaction product, from which the polysiloxane compound could not be separated by fractional precipitation. This mean that the polysiloxane compound reacted with the hydroxyethyl cellulose. By analysis, the polysiloxane segment content was found to be about 5.8%.

REFERENCE EXAMPLE A8

In place of the polysiloxane compound of Example A1, Carbon Fluoride Compound (16) was used under otherwise similar conditions to those of A1, thereby obtaining a releasable graft copolymer.

REFERENCE EXAMPLE A9

In place of the polysiloxane compound of Example A2, Carbon Fluoride Compound (18) was used under otherwise similar conditions to those of A2, thereby obtaining a releasable graft copolymer.

REFERENCE EXAMPLE A10

In place of the polysiloxane compound of Example A5, Carbon Fluoride Compound (10) was used under otherwise similar conditions to those of A5, thereby obtaining a releasable graft copolymer.

REFERENCE EXAMPLE A11

In place of the polysiloxane compound of Example A5, laurylaminoacrylate was used under otherwise similar conditions to those of A5, thereby obtaining a releasable graft copolymer.

REFERENCE EXAMPLE A12

In place of the polysiloxane compound of Example A5, vinyl stearate and a methacrylate of Carbon Fluoride Compound (14) were used at a molar ratio of 1:1 under otherwise similar conditions to those of A5, thereby obtaining a releasable graft copolymer.

REFERENCE EXAMPLE A13

A releasable graft copolymer XS-315 (acrylic silicone resin) commercialized by Toa Gosei K. K.

REFERENCE EXAMPLE A14

A releasable graft copolymer XSA-300 (acrylic silicone resin) commercialized by Toa Gosei K. K. Examples Al to A14

Synthetic paper (having a thickness of 150 μm; Yupo FPG-150 commercialized by Oju Yuka K. K.) was used as a substrate sheet. The sheet was coated on one side with a coating solution having the following composition to a dry coverage of 5.0 g/m$^2$by a bar coater, and was thereafter dried by a dryer and then in an oven of 80° C. for 10 minutes to form a dye-receiving layer.

| Composition for Dye-Receiving Layer | |
|---|---|
| Polyester resin (Vylon 600 commercialized by Toyobo Co., Ltd.) | 4.0 parts |
| Vinyl chloride/vinyl acetate copolymer (#1000A by Denki Kagaku Kogyo K.K.) | 6.0 parts |
| Amino-modified silicone (X-22-3050C by The Shin-Etsu Chemical Co., Ltd.) | 0.2 parts |
| Epoxy-modified silicone (X-22-3000E by The Shin-Etsu Chemical Co., Ltd.) | 0.2 parts |
| Methyl ethyl ketone/toluene (at a weight ratio of 1:1) | 89.6 parts |

With a bar coater, the aforesaid film was coated on the back side with a primer layer coating solution having the following composition to a dry coverage of 1.0 g/m$^2$, followed by drying with a dryer. The resulting coating was further coated with a slip layer coating solution having the following composition to a dry coverage of 3.0 g/m$^2$ by means of a bar coater, and was thereafter dried with a dryer and then in an oven of 80° C. for 10 minutes to form a primer layer. In this manner, a number of heat transfer image-receiving sheets according to this invention were obtained.

| Primer Layer Coating Composition | |
|---|---|
| Polyester polyol (Adcoat commercialized by Toyo Morton Co., Ltd.) | 15.0 parts |
| Methyl ethyl ketone/dioxane (at a weight ratio of 2:1) | 85.0 parts |
| **Slip Layer Coating Composition** | |
| Graft copolymers of Reference Examples Al-A14 | 10.0 parts |
| Nylon filler (Orgasol 2002D commercialized by Nippon Rirusan K.K.) | 0.1 part |
| Methyl ethyl ketone/toluene (at a weight ratio of 1:1) | 89.9 parts |

EXAMPLE A15

In lieu of the substrate sheet of Example A1, a transparent polyethylene terephthalate film (of 100 μm in thickness; T-100 commercialized by Toray Industries Co., Ltd.) under otherwise similar conditions to those of A1, thereby obtaining a heat transfer image-receiving sheet according to this invention.

EXAMPLES A16 to A18

For the slip layer forming composition of Example A1, the following composition was used under otherwise similar conditions to those of A1, thereby obtaining heat transfer image-receiving sheets according to this invention.

| Slip Layer Forming Composition | |
|---|---|
| Graft copolymers of Reference Examples A1-A3 | 6.0 parts |
| Acrylic resin (BR-85 commercialized by Mitsubishi Rayon Co., Ltd.) | 4.0 parts |
| Nylon filler (Orgasol 2002D by Nippon Rirusan Co., Ltd.) | 0.1 part |
| Silica | 0.1 part |
| Methyl ethyl ketone/toluene (at a weight ratio of 1:1) | 89.8 parts |

COMPARATIVE EXAMPLE A1

In place of the slip layer coating solution of Example A1, the following coating solution was used under otherwise similar conditions to those of A1, thereby obtaining a comparative heat transfer image-receiving sheet.

| Slip Layer Forming Composition | |
|---|---|
| Acrylic resin (BR-85 commercialized by Mitsubishi Rayon Co., Ltd.) | 10.0 parts |
| Nylon filler (Orgasol 2002D by Nippon Rirusan Co., Ltd.) | 0.1 part |
| Methyl ethyl ketone/toluene (at a weight ratio of 1:1) | 89.9 parts |

COMPARATIVE EXAMPLE A2

In Example A1, no slip layer was provided.

USAGE EXAMPLE A

While the dye and dye-receiving layers were located in opposite relation, each of the heat transfer image-receiving sheets according to this invention and for the purpose of comparison was overlaid on a sublimation type of yellow heat transfer sheet (commercialized by Dai Nippon Printing Co., Ltd.). With a thermal sublimation transfer printer (VY-50 by Hitachi, Ltd.), a printing energy of 90 mJ/mm$^2$ was applied from the back side of the heat transfer sheet to the image-receiving sheet through the thermal head to obtain prints.

ESTIMATION

(1) Degree of Curling by Printing

Each of the aforesaid image-receiving sheets was cut to an A4 size and then printed. The resulting print was horizontally placed, and how much it was curled up at the four corners was measured. Estimation was made by averaging the four values.

(2) Sheet Input and Output

A stack of 50 heat transfer image-receiving sheets were placed on a printer's sheet feeder unit for carrying out continuous printing according to the procedures of Usage Example. However, each sheet was coated with a black ink at the leading end and marked in a black ink on both sides so as to permit it to respond to a sensor.

Such a printing cycle was repeated 5 times. In Table 1 to follow, "good" indicates that no problem arose in connection with sheet input and output, and "bad" that multiple feeding of two or more sheets took place during the input and sheet (already printed) jamming occurred during the output. The results are reported in Table 1.

As will be understood from Table 1, troubles associated with sheet input and output can all be eliminated. This is because the specific graft copolymers forming the slip layers impart curlproofness and improved slip properties and blocking resistance to the image-receiving sheets according to this invention.

TABLE 1

| | Graft Copolymers of Ref. Exs. | Degree of Curling of Prints | Sheet Input/Output |
|---|---|---|---|
| Ex. A1 | Ref. Ex. A1 | 0.3 | Good |
| Ex. A2 | Ref. Ex. A2 | 0.3 | Good |
| Ex. A3 | Ref. Ex. A3 | 0.5 | Good |
| Ex. A4 | Ref. Ex. A4 | 0.5 | Good |
| Ex. A5 | Ref. Ex. A5 | 0.4 | Good |
| Ex. A6 | Ref. Ex. A6 | 0.6 | Good |
| Ex. A7 | Ref. Ex. A7 | 0.4 | Good |
| Ex. A8 | Ref. Ex. A8 | 0.5 | Good |
| Ex. A9 | Ref. Ex. A9 | 0.6 | Good |
| Ex. A10 | Ref. Ex. A10 | 0.5 | Good |
| Ex. A11 | Ref. Ex. A11 | 0.5 | Good |
| Ex. A12 | Ref. Ex. A12 | 0.6 | Good |
| Ex. A13 | Ref. Ex. A13 | 0.5 | Good |
| Ex. A14 | Ref. Ex. A14 | 0.4 | Good |
| Ex. A15 | Ref. Ex. A1 | 0.5 | Good |
| Ex. A16 | Ref. Ex. A1 | 0.4 | Good |
| Ex. A17 | Ref. Ex. A2 | 0.5 | Good |
| Ex. A18 | Ref. Ex. A3 | 0.5 | Good |
| Comp. Ex. A1 | — | 0.5 | Bad |
| Comp. Ex. A2 | — | 3.5 | Bad |

REFERENCE EXAMPLE B1

A transparent polyethylene terephthalate film (of 100 μm in thickness; T-100 commercialized by Toray Industries, Inc.) was used as a substrate sheet. Next, the sheet was coated on one side with a coating solution having the following composition to a dry coverage of 5.0 g/m$^2$ by a bar coater, and was thereafter dried by a dryer and then in an oven of 80° C. for 10 minutes to form a dye-receiving layer.

| Composition for Dye-Receiving Layer | |
|---|---|
| Polyester resin (Vylon 600 commercialized by Toyobo Co., Ltd.) | 4.0 parts |
| Vinyl chloride/vinyl acetate copolymer (#1000A by Denki Kagaku Kogyo K.K.) | 6.0 parts |
| Amino-modified silicone (X-22-3050C by The Shin-Etsu Chemical Co., Ltd.) | 0.2 parts |
| Epoxy-modified silicone (X-22-3000E by The Shin-Etsu Chemical Co., Ltd.) | 0.2 parts |
| Methyl ethyl ketone/toluene (at a weight ratio of 1:1) | 89.6 parts |

With a bar coater, the aforesaid film was coated on the back side with a primer layer coating solution having the following composition to a dry coverage of 1.0 g/m$^2$, followed by drying with a dryer. The resulting coating was further coated with a curlproof layer coating solution having the following composition to a dry coverage of 3.0 g/m$^2$ by means of a bar coater, and was thereafter dried with a dryer and then in an oven of 80° C. for 10 minutes to rom a curlproof layer. In this manner; a heat transfer image-receiving sheet according to this invention was obtained.

| Primer Layer Coating Composition | |
|---|---|
| Polyester polyol (Adcoat commercialized by Toyo Morton Co., Ltd.) | 15.0 parts |
| Methyl ethyl ketone/dioxane (at a weight ratio of 2:1) | 85.0 parts |
| **Composition for Curlproof Layer** | |
| Acrylic resin (BR-85 commercialized by Mitsubishi Rayon Co., Ltd.) | 10.0 parts |
| Filler (Orgasol 2002D by Nippon Rirusan K.K.) | 0.1 part |
| Methyl ethyl ketone/toluene (at a weight ratio of 1:1) | 89.9 parts |

EXAMPLE B1

Figure 3A:
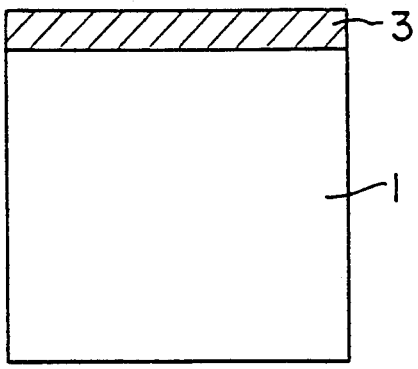
FIGS. 3A, 3B, 3C, 3D, 3E and 3F each are a plan view of the heat transfer image-receiving sheet which embodies this invention.
Figure 3B:
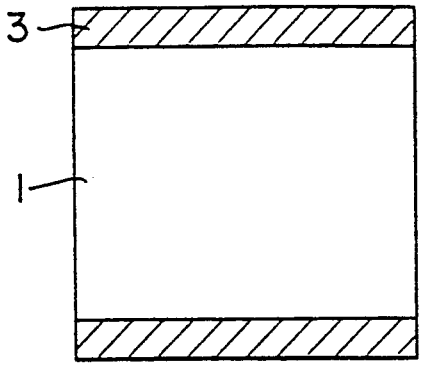
Figure 3C:
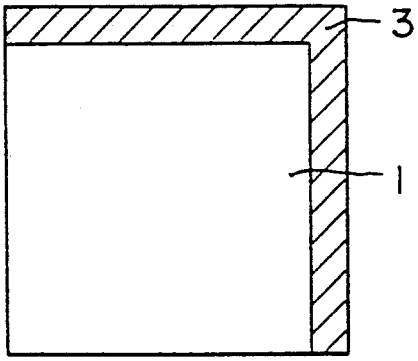
Figure 3D:
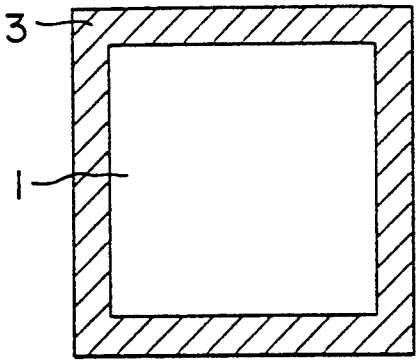
Figure 3E:
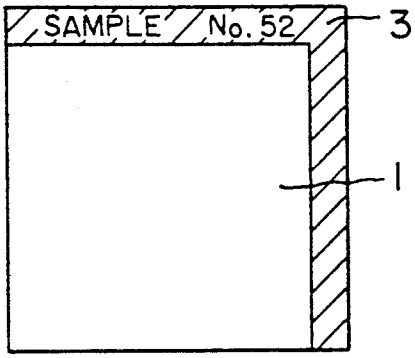
Figure 3F:
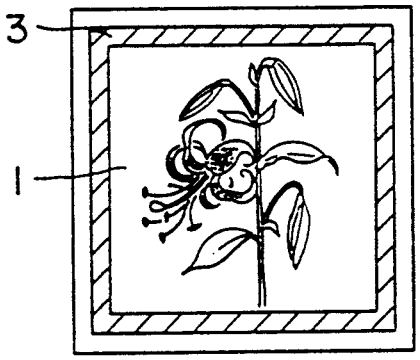

Such a detection mark as shown in FIG. 3A was provided on the back side of the transparent type of heat transfer image-receiving sheet of Ref. Ex. B1 with the following transparent ink, thereby obtaining a transparent heat transfer image-receiving sheet according to this invention.

| | |
|---|---|
| Dye (C.I. Disperse Red 60) | 1.0 part |
| Binder (BR-85 commercialized by Mitsubishi Rayon Co., Ltd.) | 5.0 parts |
| Solvent (methyl ethyl ketone) | 92.0 parts |

EXAMPLE B2

Such a detection mark as shown in FIG. 3A was provided on the back side of the transparent type of heat transfer image-receiving sheet of Ref. Ex. B1 with the following transparent ink, thereby obtaining a transparent heat transfer image-receiving sheet according to this invention.

| | |
|---|---|
| Dye (C.I. Disperse Yellow 141) | 0.5 parts |
| Dye (C.I. Solvent Blue 63) | 0.5 parts |
| Binder (#1000A commercialized by Denki Kagaku Kogyo K.K.) | 5.0 parts |
| Solvent (methyl ethyl ketone and toluene) | 91.0 parts |

EXAMPLE B3

Such a detection mark as shown in FIG. 3A was provided on the back side of the transparent type of heat transfer image-receiving sheet of Ref. Ex. B1 with the following transparent ink, thereby obtaining a transparent heat transfer image-receiving sheet according to this invention.

| | |
|---|---|
| Dye (Phthalocyanine Blue) | 3.0 parts |
| Binder (BR-85 commercialized by Mitsubishi Rayon Co., Ltd.) | 5.0 parts |
| Solvent (methyl ethyl ketone and toluene) | 92.0 parts |

EXAMPLE B4

Such a detection mark as shown in FIG. 3A was provided on the back side of the transparent type of heat transfer image-receiving sheet of Ref. Ex. B1 with the following transparent ink, thereby obtaining a transparent heat transfer image-receiving sheet according to this invention.

| | |
|---|---|
| Pigment (Brilliant Carmine 6B) | 1.5 parts |
| Pigment (Pigment Yellow) | 1.5 parts |
| Binder (BR-85 commercialized by Mitsubishi Rayon Co., Ltd.) | 5.0 parts |
| Solvent (methyl ethyl ketone and toluene) | 92.0 parts |

COMPARATIVE EXAMPLE B1

Such a detection mark as shown in FIG. 3A was provided on the back side of the transparent type of heat transfer image-receiving sheet of Ref. Ex. B1with the following transparent ink, thereby obtaining a comparative transparent heat transfer image-receiving sheet.

| | |
|---|---|
| Pigment (titanium oxide) | 2.0 parts |
| Binder (cellulose acetate L-70 commercialized by Daicel Chemical Industries, Ltd.) | 5.0 parts |
| Solvent (ethyl acetate) | 93.0 parts |

COMPARATIVE EXAMPLE B2

Such a detection mark as shown in FIG. 3A was provided on the back side of the transparent type of heat transfer image-receiving sheet of Ref. Ex. B1 with the following transparent ink, thereby obtaining a comparative transparent heat transfer image-receiving sheet.

| | |
|---|---|
| Pigment (carbon black) | 2.0 parts |
| Binder (cellulose acetate L-70 commercialized by Daicel Chemical Industries, Ltd.) | 5.0 parts |
| Solvent (ethyl acetate) | 93.0 parts |

USAGE EXAMPLE B1

While the dye and dye-receiving layers were located in opposite relation, each of the heat transfer image-receiving sheets according to this invention and for the purpose of comparison was overlaid on a sublimation type of yellow heat transfer sheet (commercialized by Dai Nippon Printing Co., Ltd.). With a thermal sublimation transfer printer (VY-100 by Hitachi, Ltd.), a printing energy of 90 mJ/mm$^2$ was applied from the back side of the heat transfer sheet to the image-receiving sheet through the thermal head, followed by magenta and cyan printing to obtain a full-color image. The print was then projected through OHP hardware (Model 007 commercialized by Sumitomo 3M Co., Ltd.) on a white screen at a magnification of 3 for visually observing the projected detection mark and measuring the degree of curling of the image-receiving sheet at the time of projection. The results are reported in Table 2.

EXAMPLE B5

The heat transfer image-receiving sheet of Ref. Ex. B1 was used to form a full-color image in the same manner as in Usage Example B1. At the same time, such a detection mark as illustrated in FIG. 3F was printed in purple around the image. Estimation was made in the same manner as in Usage Example B1.

ESTIMATION

(1) Color of Detection Mark

The projected mark was visually observed.

(2) Transmission Density

The detection mark of the image-receiving sheet was measured with a transmission densitometer TD-904 (Macbeth Co., Ltd.).

(3) Degree of Curling

Each of the aforesaid image-receiving sheets was cut to an A4size and then printed. The resulting print was horizontally placed on glass plate at a temperature of 45° C., and how much it was curled up at four corners was measured. Estimation was made by averaging the four values.

TABLE 2

| Sample | Color of Detection Marks | Color of Detection Marks at the time of projection | Transmitting Density | Degree of Curling |
|---|---|---|---|---|
| Ex. B1 | red | red | 0.68 | 5 mm |
| Ex. B2 | green | green | 0.58 | 5 mm |
| Ex. B3 | blue | blue | 0.46 | 5 mm |
| Ex. B4 | red | red | 0.60 | 5 mm |
| Ex. B5 | purple | purple | 0.75 | 5 mm |
| Comp. Ex. B1 | white | black | 0.30 | 5 mm |
| Comp. Ex. B2 | black | black | 0.48 | 5 mm |

EXAMPLE C1

A 100 μm thick polyethylene terephthalate film was coated on one side with an adhesive layer coating solution (a-1) specified in Table 3 to a dry coverage of 1.0 μm, followed by drying. The resulting adhesive layer was further coated with a back layer coating solution (b-2) set out in Table 3 to a dry coverage of 1 μm, followed by drying. Then, a dye-receiving layer coating solution (c-2) was coated on the side of the film opposite to the back layer to a dry coverage of 5 μm, followed by drying. In this manner, an image-receiving sheet according to this invention was obtained.

EXAMPLE C2 & C3 AND COMPARATIVE EXAMPLE C1

In place of the coated solutions employed in Example C1, the following coating solutions were used under otherwise similar conditions to those applied in Ex. C1.

Example C2: (a-2), (b-1) and (c-2)

Example C3: (a-2), (b-2) and (c-1)

Comp. Ex. C1: (a-2), (b-2) and (c-2)

EXAMPLE C4

Added to 100 parts of polyethylene terephthalate were 0.03 parts of a dye (4), followed by heating and mixing at 290° C. Afterwards, the mixture was treated in known manners to obtain an unstretched film. This film was in turn stretched in the warp and weft directions, each at a stretching ratio of 3, and further thermally fixed at 220° C. to obtain a blue polyester film of 100 μm in thickness. In the same manner as in Ex. C1, the coating solutions (a-2), (b-2) and (c-2) were coated on the polyester film to obtain an image-receiving sheet.

TABLE 3

| Coating Solutions | | Composition | |
|---|---|---|---|
| A | a-1 | Polyester polyol (Adcoat by *1) | 15 parts |
| | | Dye (1) | 0.15 parts |
| | | Methyl ethyl ketone | 59.85 parts |
| | | Dioxane | 25 parts |
| | a-2 | Polyester polyol (Adcoat by *1) | 15 parts |
| | | Methyl ethyl ketone | 59.85 parts |
| | | Dioxane | 25 parts |
| B | b-1 | Acrylic resin (BR-85 by *2) | 10.0 parts |
| | | Finely divided organic particles (Orgasol 2002D by *3) | 0.1 part |
| | | Dye (2) | 0.1 part |
| | | Toluene | 40.0 parts |
| | | Methyl ethyl ketone | 49.8 parts |
| | b-2 | Acrylic resin (BR-85 by *2) | 10.0 parts |
| | | Finely divided organic particles (Orgasol 2002D by *3) | 0.1 part |
| | | Toluene | 40.0 parts |
| | | Methyl ethyl ketone | 49.9 parts |
| C | c-1 | Polyester resin (Vylon 600 by *4) | 4.0 parts |
| | | Vinyl chloride/vinyl acetate copolymer (#1000A by *5) | 6.0 parts |
| | | Dye (3) | 0.02 parts |
| | | Amino-modified silicone (X-22-3050C by *6) | 0.2 parts |
| | | Epoxy-modified silicone (X-22 3000E by *6) | 0.2 parts |
| | | Toluene | 45.0 parts |
| | | Methyl ethyl ketone | 44.58 parts |
| | c-2 | Polyester resin (Vylon 600 by *4) | 4.0 parts |
| | | Vinyl chloride/vinyl acetate copolymer (#1000A by *5) | 6.0 parts |
| | | Amino-modified silicone (X-22 3050C by *6) | 0.2 parts |
| | | Epoxy-mcdified silicone (X-22-3000E by *6) | 0.2 parts |
| | | Toluene | 45.0 parts |
| | | Methyl ethyl ketone | 44.58 parts |

A: for adhesive layer.
B: for back layer and
C: for dye-receiving layer.
*1: Toyo Morton.
*2: Mitsubishi Rayon
*3: Nippon Rirusan
*4: Toyobo
*5: Denki Kagaku Kogyo
*6: The Shin-Etsu Chemical.

Dye (1)

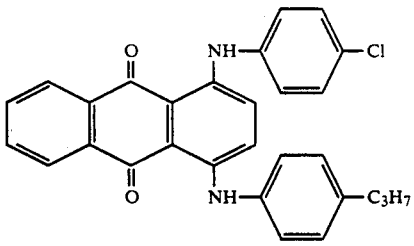

Dye (2)

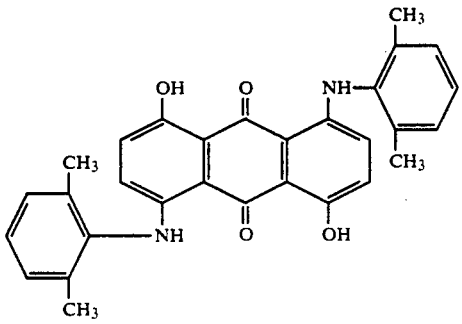

-continued

Dye (3)

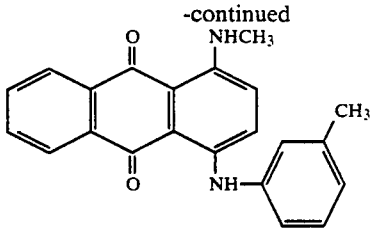

Dye (4)

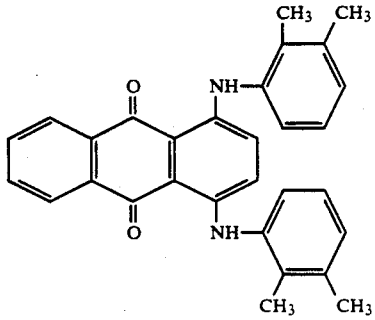

ESTIMATION

(1) Chromaticity Value

Transmitting spectra were measured through a spectrophotometer UV-3100 (commercialized by Shimadzu Corporation), and the values for x and y were found according to the standard CIE 1391 system of color representation. The x and y values are reported in Table 4.

(2) Thermal Degradation Testing

Color changes were visually observed before and after the samples were allowed to stand at 70° C. for 300 hours.

(3) Optical Degradation Testing

Hue changes were visually observed before and after the samples were irradiated at a total dosage of 70 $kJ/m^2$ with a xenon fedeometer.

TABLE 4

| | x | y |
|---|---|---|
| Example C1 | 0.284 | 0.301 |
| Example C2 | 0.280 | 0.295 |
| Example C3 | 0.305 | 0.310 |
| Example C4 | 0.293 | 0.307 |
| Comp. Ex. C1 | 0.315 | 0.321 |

The image-receiving sheet according to Comp. Ex. C1 suffered a strong yellowing by heat and light, but the image-receiving sheets according to Examples C1-C4 did not substantially.

What is claimed is:

1. A heat transfer image-receiving sheet comprising:

a substrate sheet;

a dye-receiving layer formed on the front side of the substrate sheet and comprising a resin for receiving a sublimable dye transferred in the form of an image from a heat transfer sheet, said resin maintaining the dye image in said dye-receiving layer; and a slip layer formed on the back side of the substrate sheet to prevent said heat transfer image-receiving sheet from striking to a dye-receiving layer of other heat transfer image-receiving sheets, said slip layer containing a polymer comprising a graft copolymer having at least one of polysiloxane, fluoroalkyl and long-chain alkyl segments grafter on its main chain, wherein the segments account of 3 to 60% by weight of the graft copolymer.

2. A heat transfer image-receiving sheet as recited in claim 1, wherein the main chain of said graft copolymer is a resin based on acrylic, vinyl, polyester, polyurethane, polyamide or cellulose.

3. A heat transfer image-receiving sheet as recited in claim 1, wherein said slip layer further comprises a resin having a Tg of at least 60° C., said resin forming the main chain of the graft copolymer.

4. A heat transfer image-receiving sheet as recited in claim 1, wherein said slip layer contains at least one of organic particles and inorganic particles having a particle size of 0.5 to 30 microns, the particles being present in an amount of 0.02 to 10% by weight of the slip layer.

5. A heat transfer image-receiving sheet as recited in claim 1, wherein said substrate sheet is treated on its surface such that it is easily bondable.

6. A heat transfer image-receiving sheet as recited in claim 1, wherein said substrate sheet and said dye-receiving layer are both transparent.

7. A heat transfer image-receiving sheet as recited in claim 6, further comprising a light transmitting, colored detection mark having a transmission density of 0.3 to 0.8.

8. A heat transfer image-receiving sheet as recited in claim 7, wherein said detection mark is formed on an ink containing a dye or transparent pigment.

9. A heat transfer image-receiving sheet as recited in claim 7, wherein said detection mark is formed by the heat transfer of a sublimable dye.

10. A heat transfer image-receiving sheet as recited in claim 7, further comprising a curlproof layer formed on at least one side of the substrate sheet, said curlproof layer comprising a resin having a shrinkage upon heating in the range of −1.0 to 1.5%, as measured at 100° C. for 10 minutes according to JIS-K-6734, and a softening temperature of at least 90° C.

11. A heat transfer image-receiving sheet as recited in claim 10, wherein said curlproof layer contains a filler, said filler accounting for 0.02 to 10.0% by weight of said curlproof layer.

12. A heat transfer image-receiving sheet comprising:

a transparent substrate sheet;

a transparent dye-receiving layer formed on the front surface side of the transparent substrate sheet; and a light transmitting, colored detection mark provided on a portion of at least one side surface of said heat transfer image-receiving sheet, said detection mark having a transmission density of 0.3 to 0.8.

13. A heat transfer image-receiving sheet as recited in claim 12, wherein said detection mark is formed of an ink containing a dye or transparent pigment.

14. A heat transfer image-receiving sheet as recited in claim 12, wherein said detection mark is formed by the heat transfer of a sublimable dye.

15. A heat transfer image-receiving sheet as recited in claim 12, wherein a curlproof layer comprising a resin having a low heat expandable/shrinkable property is formed on at least one side of the substrate sheet.

16. A heat transfer image-receiving sheet as recited in claim 15, wherein said curlproof layer contains a filler, said filler accounting for 0.02 to 10.0% by weight of said curlproof layer.

17. A heat transfer image-receiving sheet as recited in claim 12, which is colored by a blue dye or pigment.

18. A heat transfer image-receiving sheet as recited in claim 17, wherein the chromaticity value of said blued heat transfer image-receiving sheet lies in a region of the CIE 1931 system of color representation surrounded by the following three points:

(x=0.310, y=0.316)
(x=0.285, y=0.280)
(x=0.275, y=0.320).

* * * * *